US005879594A

United States Patent [19]

Holtzman

[11] Patent Number: 5,879,594

[45] Date of Patent: Mar. 9, 1999

[54] TEMPERATURE RESPONSIVE PRESSURE SPLITTER

[76] Inventor: Barry L. Holtzman, 3907 Evergreen Rd., Eagle River, Wis. 54521

[21] Appl. No.: 891,433

[22] Filed: Jul. 10, 1997

[51] Int. Cl.[6] ..... F02M 7/12

[52] U.S. Cl. ..... 261/39.2; 137/79

[58] Field of Search ..... 261/69.1, 70, 69.2, 261/72.1, 1, 39.1, 66, 39.2, 39.3, 39.4, DIG. 67, DIG. 68, DIG. 69; 137/79, 80, 81.1; 236/102

[56] References Cited

U.S. PATENT DOCUMENTS

| | | | |
|---|---|---|---|
| 1,740,917 | 12/1929 | Beck | 261/72.1 |
| 1,785,681 | 12/1930 | Goudard | 261/41.5 |
| 1,799,585 | 4/1931 | Ensign | 261/72.1 |
| 1,851,711 | 3/1932 | Linga | 261/72.1 |
| 3,456,722 | 7/1969 | Cornelius | 137/79 X |
| 3,652,065 | 3/1972 | Casey et al. | 261/DIG. 69 |
| 3,696,997 | 10/1972 | Gifford | 236/102 |
| 3,719,322 | 3/1973 | Gifford | 236/102 |
| 3,730,157 | 5/1973 | Gerhold | 261/DIG. 67 |
| 3,789,812 | 2/1974 | Berry et al. | 261/DIG. 67 |
| 3,833,171 | 9/1974 | Gifford | 236/102 |
| 3,859,397 | 1/1975 | Tryon | 261/39.2 |
| 3,861,366 | 1/1975 | Masaki et al. | 123/438 |
| 3,872,189 | 3/1975 | Brown et al. | 261/69.1 X |
| 3,880,963 | 4/1975 | Bier et al. | 261/39.3 |
| 3,968,189 | 7/1976 | Bier | 261/DIG. 56 |
| 4,066,091 | 1/1978 | Itoh et al. | 137/79 |
| 4,102,315 | 7/1978 | Fahim et al. | 261/39.2 X |
| 4,376,738 | 3/1983 | Reinmuth | 261/63 |
| 4,574,755 | 3/1986 | Sato et al. | 123/320 |
| 4,660,525 | 4/1987 | Mesman | 123/525 |
| 4,759,883 | 7/1988 | Woody et al. | 261/39.1 |
| 5,021,198 | 6/1991 | Mann | 261/44.3 |
| 5,772,928 | 6/1998 | Holtzman | 261/70 X |

OTHER PUBLICATIONS

Polaris Industries Carburetor Setting Chart, Aug. 1994.

*Primary Examiner*—Richard L. Chiesa

[57] ABSTRACT

A pressure splitter is made having a series or orifices, at least one of which has its effective size change with changes in temperature. This size change is provided by using materials with different thermal expansion rates, these different rates changing the relative positions of a body and the free end of a temperature responsive member. This same principle can be used in conjunction with a pressure responsive element, such as a sealed bellows, to provide a splitter which has an intermediate pressure which changes in response to both temperature and pressure. A splitter with temperature compensation only can be used to effectively modify carburetor fuel flow providing a more constant fuel/air ratio. A splitter using both temperature and pressure responsive elements can be used to more effectively maintain carburetor fuel/air ratio over a wide range of relative air densities caused by changes in atmospheric temperature and altutude.

12 Claims, 6 Drawing Sheets

TEMPERATURE RESPONSIVE PRESSURE SPLITTER

BACKGROUND

1. Field of Invention

This invention relates generally to a pressure splitter having a system of orifices with a pressure sensing port located between two of the orifices, at least one orifice having its size vary with temperature. As the temperature controlled orifice(s) change(s) in effective size, the pressure in the sensing port changes. This temperature controlled orifice can be used in conjunction with fixed orifices, or may be used in conjunction with pressure controlled orifices. It can be used in gas or liquid mediums. This device is especially effective in the regulation of carburetor fuel flow as a function of ambient air temperature, or as a function of ambient air temperature and atmospheric pressure.

2. Description of Prior Art

A pressure splitter is a hydraulic or pneumatic device which has an inlet opening to a region of high pressure and an outlet opening to a region of lower pressure. At least two orifices are positioned in series between this inlet and outlet, resulting in an intermediate pressure existing in the region between the two orifices. Each orifice performs a throttling operation in which total pressure drops across the orifice. The pressure drop across both orifices essentially equals the total pressure applied to the splitter, and the intermediate pressure therefore lies somewhere between the inlet and outlet pressures depending on the relative sizes of the orifices. The orifices are usually small in area compared to the chambers to which they are connected, therefore establishing a low fluid velocity ahead of the orifice. The pressure drop across the orifice is a result of the force required to accelerate the fluid medium through the orifice. More than two orifices can be used in the splitter, in various series and parallel combinations, but usually just two series orifices are used. The orifices can be fixed in dimension and consequently their area, but they may also be variable in area, either manually or automatically adjusted by a needle valve, for instance.

Carburetors operate using air pressure differences acting to force a fuel into a bore of the carburetor, and hence to an engine. This fuel flow is through one or more fuel metering orifices. Modern carburetors use multiple systems or circuits to provide the proper fuel/air ratio required for all engine operating parameters. These systems provide a balance between economy and power, enabling maximum power to be delivered by the engine upon demand, but maximum economy whenever possible.

Two basic elements determine the fuel flow in any of these various circuits. The first element is the physical size of the fuel metering orifice, and to a lesser extent, connecting passageways which comprise the particular fuel circuit. The metering orifice is usually sized to be considerably smaller than the other parts of the fuel delivery system, and for the purpose of analyzing fuel delivery, it can be assumed that the metering orifice constitutes the entire fuel delivery system. The second element is the pressure difference existing across the fuel delivery system, or essentially, the pressure existing across the metering orifice. For any given set of conditions, the fuel flow through the fuel delivery system varies approximately as the square root of this pressure difference.

The pressure difference acting across the fuel metering orifice in its most basic configuration consists of the pressure existing on the fuel in the fuel chamber of the carburetor, less the pressure existing in the carburetor bore where the outlet of the fuel delivery system is located, less the head pressure of the fuel. The pressure existing on the fuel in the fuel chamber is controlled by an average reference pressure established by a vent. If the vent is entirely external to the carburetor and its air induction passage, the venting is called external, and atmospheric pressure is the average reference pressure used for the carburetor. If the vent communicates with a region of the bore or other area of the air induction passage, for instance the air cleaner, this venting is called internal. In this case, the average reference pressure used for the carburetor will be slightly less than atmospheric, depending on the location of the pressure sensing end of the vent. Both types of venting, internal and external, are well known in the art.

The pressure existing in the carburetor bore and other parts of the air induction system, and hence existing at the outlet of the fuel delivery system, is determined by engine operating conditions, the position of a throttle valve, a variable venturi if so equipped, and the shape and cross sectional area of the carburetor bore. As a gas, or in this case air, is moving at a velocity, the static pressure (the pressure measured by a pressure sensing orifice with its surface parallel to this flow) will be lower in regions where the velocity is greater. Therefore, as engine speed is increased and the carburetor throttle is opened, air velocity in the bore increases, and pressures perpendicular to the wall of the bore decrease. Also, the bore is normally shaped so that there is a region having a decreasing cross sectional area, called a converging section. The portion having the smallest cross sectional area is called the throat, and air speed will be highest in this region. The converging section and throat comprise the venturi; most carburetors have a venturi with fixed dimensions, but some carburetors have a venturi with operably variable dimensions. It is in the throat that a high speed fuel delivery orifice is usually located. The surface of this fuel delivery orifice is usually parallel to the air flow, or in other words perpendicular to a radius of the bore. Locating the fuel delivery orifice in the throat perpendicular to a bore radius gives the maximum fuel flow possible for a given orifice, bore design, and engine operating condition, since this is the region of the bore where the static pressure is lowest.

The fuel head pressure is simply the pressure required to raise the fuel against gravity a height equivalent to the difference between the level of the fuel delivery orifice in the bore and the level of the fuel in the fuel chamber. It is important that this level be controlled for uniform operation of the carburetor.

There are two basic types of carburetors, float bowl carburetors and wet diaphragm carburetors. In a typical float bowl type carburetor, fuel flows from a larger fuel tank into the float bowl of the carburetor, the level of fuel in the float bowl being determined by a float-actuated valve. This system is well known in the prior art and is discussed in my co-pending applications Ser. Nos. 08/664,187 (now U.S. Pat. No. 5,772,928) and 08/846,815. This fuel level, as discussed above, is important in determining overall carburetor performance. In this case, the venting system used, whether internal, external, or a combination of both, determines the pressure existing in the air occupying the space above the fuel internal to the carburetor. This pressure may contain pressure pulses due to fuel inlet valve instability or due to pressure pulses in the carburetor bore, but the average of this pressure is one parameter which determines average carburetor fuel delivery.

In a typical wet diaphragm type carburetor, fuel flows under pressure from the larger fuel tank to the carburetor, and the pressure internal to the carburetor is controlled by a diaphragm-operated valve. This is also discussed in 08/664,187 and08/846,815. In this case, there is no fuel level specifically, as there is no void internal to the carburetor; it is completely filled with fuel. In this type carburetor, the dry side of the diaphragm, or the side of the diaphragm opposite the side in contact with the fuel, is housed in a chamber which is either internally or externally vented. The average pressure of this chamber, while not being the actual pressure existing on the fuel internal to the carburetor, is the average reference pressure which determines the fuel pressure internal to the carburetor. This average reference pressure exists on the dry side of the diaphragm, while the fuel pressure internal to the carburetor exists on the wet side of the diaphragm. The movement of this diaphragm positions the moveable member of an inlet valve, and hence regulates the average fuel pressure in the carburetor and therefore helps determine average carburetor fuel delivery.

Changes in atmospheric conditions, such as temperature, barometric pressure, and elevation, all of which determine the relative air density, have a considerable effect on the fuel delivery requirements of the engine. Changes in relative air density, without a corresponding change in carburetor tuning, cause a change in the fuel/air mixture ratio, resulting in engine loss of power or a waste of fuel. For instance, a snowmobile engine, which has carburetors tuned or jetted for proper operation at −40 degree Fahrenheit, will run overly rich and get the "blubbers" when run at +40 degrees Fahrenheit, unless the carburetor has the main jets changed to lean the mixture. In extreme cases, the mid-range operation of the carburetor must also be modified by moving or replacing a needle which affects the effective size of the fuel delivery orifice at part-throttle positions. Changing main jets and repositioning or changing mid-range needles is time consuming, results in loss of fuel, and requires partial disassembly of the carburetor. Some carburetors have external mixture screws which adjust an opening in a fuel feed port which parallels the main jet. These systems are expensive to manufacture, and each carburetor must have its own adjustment system. Also these systems work by changing the effective size of the fuel delivery orifice, and not by changing the pressure acting to move the fuel through the fuel delivery system.

Prior art has discussed the use of internal vents to regulate the flow of fuel to an engine. U.S. Pat. Nos. 1,799,585 to Ensign (1931), 1,785,681 to Goudard (1926), 1,740,917 to Beck (1926), and 1,851,711 to Linga (1932) use an internal vent orifice in the carburetor bore which has its pressure affected by the throttle position. All of these devices are complex and add considerably to the cost of machining the carburetor. Except for 1,740,917 to Beck, they are not externally adjustable, and consequently are not usable to change fuel flow necessitated by a change in atmospheric conditions, for instance. They only change the shape of the fuel flow versus engine demand curve, and for any fixed set of operating conditions, the fuel flow is determined and not adjustable. U.S. Pat. No. 1,740,917 to Beck uses an internal vent positioned adjacent the throttle, and uses a manually adjustable external vent to provide an external adjustment of the fuel flow. This system is not automatic in its operation.

U.S. Pat. No. 5,021,198 to Bostelman (1990) describes a carburetor altitude compensation system using a pressure splitter to regulate the fuel flow through the carburetors. In this system, a sealed metering chamber and diaphragm is used to position a valve (choke), which changes the intermediate pressure existing between two orifices. One orifice is located in the line from the venturi region of the carburetor bore, providing a vacuum which tends to decrease the flow of fuel. The other orifice is in the line connected to a region of essentially atmospheric pressure, for instance the air cleaner. This line tends to establish the float bowl pressure at atmospheric pressure, at which maximum fuel flow will occur. The movement of the diaphragm causes a change in the relative size of the two orifices, therefore causing a change in the intermediate pressure existing between the two orifices. This intermediate pressure is applied to the carburetor and is the carburetor reference pressure, and fuel flow varies as the reference pressure varies. This system, like the adjustment in 1,740,917 to Beck, establishes a pressure by balancing two series orifices, one or both orifices being variably throttled. Systems operating on a similar principle using valves and thermodynamic throttling are described in U.S. Pat. Nos. 3,968,189 to Bier (1976), 4,660,525 to Mesman (1987), 4,574,755 to Sato et al. (1986), 4,376,738 to Reinmuth (1983), 3,789,812 to Berry et al (1974), and 3,730,157 to Gerhold (1973). All of these systems use a valve of some nature, usually of a needle type or a sliding type, which is usually operably closed to create an effective valve opening small compared to the area of the conduits to which it is attached, and perform a throttling operation to reduce the total pressure after passing the valve. None of these systems, however, employ an atmospheric temperature controlled orifice in conjunction with a fixed or atmospheric pressure controlled orifice to regulate carburetor fuel flow.

Other carburetor fuel regulating inventions are contained in U.S. Pat. Nos. 3,859,397 to Tryon (1973) and 3,880,963 to Bier et al. (1973). These inventions use pressure or temperature sensing devices to change the effective size of the fuel metering orifice, and do not operate on the principle of affecting the carburetor reference pressure. U.S. Pat. Nos. 3,652,065 to Casey et al. (1972 and 3,861,366 to Masaki et al. (1975) use a complex system of amplifiers, sensers, and electronics or pneumatics to affect the flow of fuel through the carburetor. These two systems also do not affect fuel flow by affecting the carburetor reference pressure.

Valves utilizing materials having different thermal coefficient expansion rates to vary the open area of the valve have been developed. U.S. Pat. Nos. 3,833,171, 3,719,322, and 3,696,997 to Gifford (1974, 1973, and 1972 respectively), 4,759,883 to Woody et al. (1988), and 3,456,722 to Cornelius (1969) all describe valves operating on this principle. These valves are used to control the rate of fluid flow by changing the effective size of a flow controlling orifice, but are not used as a pressure splitter. In other words, there is no provision for a second orifice, used in conjunction with the variable orifice, to establish an intermediate pressure somewhere between the inlet pressure to the valve and the outlet pressure from the valve, and no provision for sensing this intermediate pressure. These devices are simply valves, not pressure splitters, and therefore are ineffective in establishing carburetor reference pressure.

In my co-pending application Ser. No. 08/846,815 I describe a carburetor fuel flow regulator which affects the fuel flow by varying the carburetor reference pressure. This regulator, however, uses a moveable member which changes gas flow speed parallel to an orifice, thereby affecting the static pressure existing in the orifice. Flow is isentropic, and total pressure is conserved. This regulator is not a pressure splitter.

Objects and Advantages

It is an object of this invention to provide a pressure splitter which provides an intermediate pressure which varies with ambient temperature. This variation with temperature is achieved by using at least one orifice which has its effective size change with ambient temperature. This size change is accomplished by using materials in the orifice having different rates of thermal expansion.

It is a further object of this invention to provide a pressure splitter which provides an intermediate pressure which varies in response to ambient temperature and ambient pressure. This is accomplished by using at least one orifice which has its effective area change with atmospheric temperature, and at least one orifice which has its effective area change with atmospheric pressure. These area changes are accomplished by using materials having different rates of thermal expansion along with a pressure responsive element such as a sealed bellows.

It is a further object of this invention to provide a temperature responsive pressure splitter to adjust carburetor fuel flow for changes in atmospheric temperature.

It is a further object of this invention to provide a temperature and atmospheric pressure responsive pressure splitter to adjust carburetor fuel flow for changes in atmospheric temperature and pressure.

It is a further object of this invention to provide a pressure splitter with a temperature responsive member which is able to adjust fuel flow in more than one carburetor.

It is a further object of this invention to provide a temperature responsive pressure splitter which has a construction which minimizes its thermal time constant, thereby enabling the splitter to respond rapidly to changes in temperature.

It is a further object of this invention to provide a temperature responsive pressure splitter which has an adjustable element, providing for initial carburetor tuning as well as being responsive to temperature.

Still further objects and advantages will become apparent from a consideration of the ensuing description and drawings.

DRAWING FIGURES

Reference Numerals In Drawings

Figure 1:
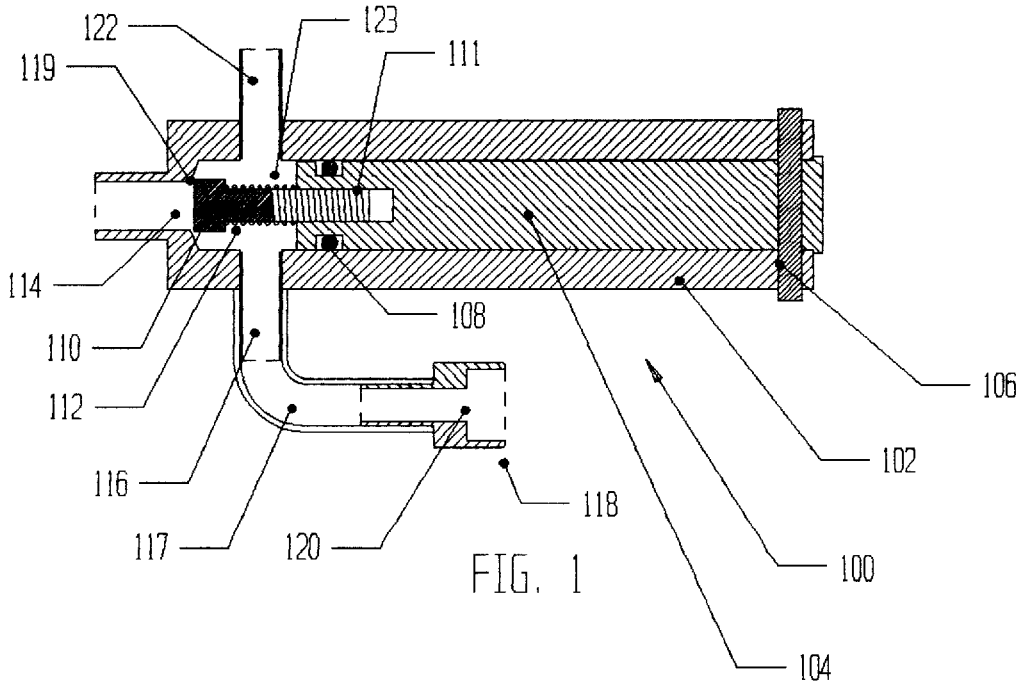
FIG. 1 shows a cross sectional view from the side of a temperature responsive pressure splitter taken in a plane coinciding with the axis of the splitter, having one orifice responsive to temperature and one orifice fixed.

08 float bowl carburetor assembly
09 wet diaphragm carburetor assembly
10 float bowl carburetor body
11 wet diaphragm carburetor body
12 float bowl
13 wet diaphragm fuel chamber
14 fuel
16 fuel level
17 float bowl air chamber
18 butterfly throttle valve
20 throttle valve pivot shaft
22 air inlet or bell
24 air/fuel outlet
25 main bore venturi
26 throat
27 main bore
28 converging section
30 air filter
40 vent/air chamber connecting conduit
42 atmospheric pressure conduit
43 tubing "T"
44 carburetor interconnecting conduit
48 main bore low pressure sensing orifice
49 low pressure connecting conduit
60 high speed fuel delivery system
61 high speed jet
62 high speed fuel delivery conduit
63 high speed fuel outlet orifice
70 low speed fuel delivery system
71 low speed jet
72 low speed fuel delivery conduit
73 low speed fuel outlet orifice
80 wet diaphragm fuel inlet assembly
81 fuel inlet conduit
82 fuel inlet valve
83 lever arm
84 spring
85 pivot pin
86 wet chamber
88 dry chamber
89 diaphragm
90 float bowl fuel inlet assembly
91 fuel inlet conduit
92 fuel inlet valve
93 fuel inlet float control mechanism
100 temperature responsive orifice assembly
102 body
104 temperature responsive member
106 pin
108 "o" ring
110 bolt
111 threads
112 spring
114 outlet
116 inlet
117 connecting conduit
118 inlet
119 temperature responsive orifice
120 fixed orifice

122 intermediate pressure sensing port
123 mixing chamber
200 pressure responsive orifice assembly
202 body
204 pressure responsive member (bellows)
206 bellows evacuation tube
208 spring
210 adjustment member
211 threads
212 "o" ring
214 outlet
218 inlet
219 pressure responsive orifice
220 snap ring
223 mixing chamber
300 temperature and pressure responsive orifice assembly
302 body
304 temperature responsive member
310 bolt
311 threads
314 outlet
318 inlet
319 temperature and pressure responsive orifice
320 inlet orifice
322 intermediate pressure sensing port
323 mixing chamber
400 flow through temperature responsive pressure splitter
402 flow through body
404 temperature responsive member
406 threads
407 positioning member
410 adjustment member
411 threads
414 outlet
418 inlet
419 temperature responsive orifice
420 inlet orifice
422 intermediate pressure sensing port
423 mixing chamber
425 cap
426 cap threads
430 adjustable member flow passages
431 through flow passage
432 positioning member flow passages

Description and Operation-FIG. 1

FIG. 1 shows a temperature responsive orifice assembly 100 having a body 102 which houses a temperature responsive member 104. The relative positions of body 102 and member 104 are rigidly fixed at pin 106, but other methods of fixing these two parts together such as threads, adhesives, etc. will work. An "o" ring 108 is used to seal and radially position member 104 in body 102. Member 104 has threads 111 to accept and position bolt 110, with spring 112 preventing unwanted rotation of bolt 110. Three openings are provided in body 102 consisting of inlet 116, outlet 114, and intermediate pressure sensing port 122. This embodiment has inlet 116 connected to inlet 118 with a fixed orifice 120 using conduit 117. The cylindrical surface defined by the projection of the head of bolt 110 onto body 102 toward outlet 114 determines the area of temperature responsive orifice 119. Port 122 is used to access the pressure existing between orifices 119 and 120. Mixing chamber 123 is used to reduce the gas or liquid flow speed before it enters temperature responsive orifice 119.

It is to be understood that this designation of the various openings as "inlets" or "outlets" is used only for reason of explanation. A reverse flow can be designed where the inlets and outlets are reversed, if this is desired. This particular designation has been adopted because it fits the immediate intended use of this invention. Also, it is to be understood that orifice 120, shown as a detachable member, can be integrally machined into body 102 if desired. The detachable orifice 120 is desirable in some cases so the area of orifice 120 can easily be changed.

The operation of this splitter is as follows. A first pressure is applied to the device before orifice 120, at inlet 118, and a second pressure is applied after orifice 119, at outlet 114, establishing a pressure differential across the two orifices. In a typical embodiment, a vacuum is applied at outlet 114, and atmospheric pressure at inlet 118. The relative sizes of orifices 119 and 120 establish a third intermediate pressure. The following equation gives an approximation to the relationship between these three pressures and the sizes of the two orifices, assuming no flow through port 122.

$$P3=(A1^2*P1+A2^2*P2)/(A1^2+A2^2)$$

where P1 is the pressure existing before orifice 120 at inlet 118 (first pressure)

P2 is the pressure existing in outlet 114 after orifice 119 (second pressure)

P3 is the intermediate pressure existing at port 122 (third pressure)

A1 is the effective cross sectional area of orifice 120

A2 is the effective cross sectional area of orifice 119

This equation is valid if the construction of orifices 119 and 120 provide throttled flow. In other words, the total pressure P1 existing before orifice 120 is reduced (throttled) to P3 after passing orifice 120 having size A1. The total pressure P3 is reduced (throttled) to the pressure P2 after passing orifice 119. Also, it is to be noted that mixing chamber 123 is made large relative to the sizes A1 and A2 to insure that air speed parallel to port 122 is small. This is to insure that static and total pressure in chamber 123 are essentially equal.

It can be seen, therefore, if orifice 119, for instance, is varied in effective area, with the size of orifice 120 fixed, the intermediate pressure P3 will change even if P1 and P2 are constant. This invention uses materials for the construction of body 102 and member 104 which have appreciably different thermal expansion coefficients. For instance, in this embodiment, body 102 is made from acetal homopolymer, a plastic having a thermal expansion coefficient of approximately 5.5E-05 cm/cm/deg F. Member 104 is made from aluminum, for instance, having an expansion coefficient of 1.22E-05 cm/cm/deg F. Bolt 110 also is important in this consideration, and a preferred material is steel having a thermal expansion coefficient of 0.65E-05 cm/cm/deg F. Other choices of materials will work as long as the materials have significantly different thermal expansion rates. The movement of the head of bolt 110 relative to body 102 is determined by the expansion rates of the materials used, by the temperature difference experienced by the assembly, and by the active length of the temperature responsive orifice assembly. This active length is the distance from pin 106 to the end of bolt 110. A typical assembly has an active length of approximately 7.6 cm,(3 inches), which yields a relative movement of the head of bolt 110 with respect to body 102 of 0.013 cm (0.005 inches) for a 40 degree F change in temperature. This relative bolt head movement changes the effective size of orifice 119, which is A2 in the above equation, therefore changing the intermediate pressure P3 for a given P1, P2, and A1. Specifically, in this case, as the temperature drops, the value of A2 decreases because the bolt head moves toward the body. This is because body 102 decreases in length faster than member 104 and bolt 110. This has the effect of moving P3 closer to P1, or in other words, P3 is increased. If the materials used for body 102 and member 104 and bolt 110 are reversed, the above effect on P3 is reversed.

Initial adjustment of this splitter is accomplished by rotating screw 110, thus establishing the initial positioning of screw 110 relative to body 102, thus establishing the area A2 of orifice 119. Of course this initial positioning must be performed at a designated temperature, because this relative distance changes with temperature. This initial positioning has been found to be an effective means for providing overall carburetor/engine tuning, eliminating to a large extent the need for other adjustments such as changing main jets and mid-range needles.

Figure 2:
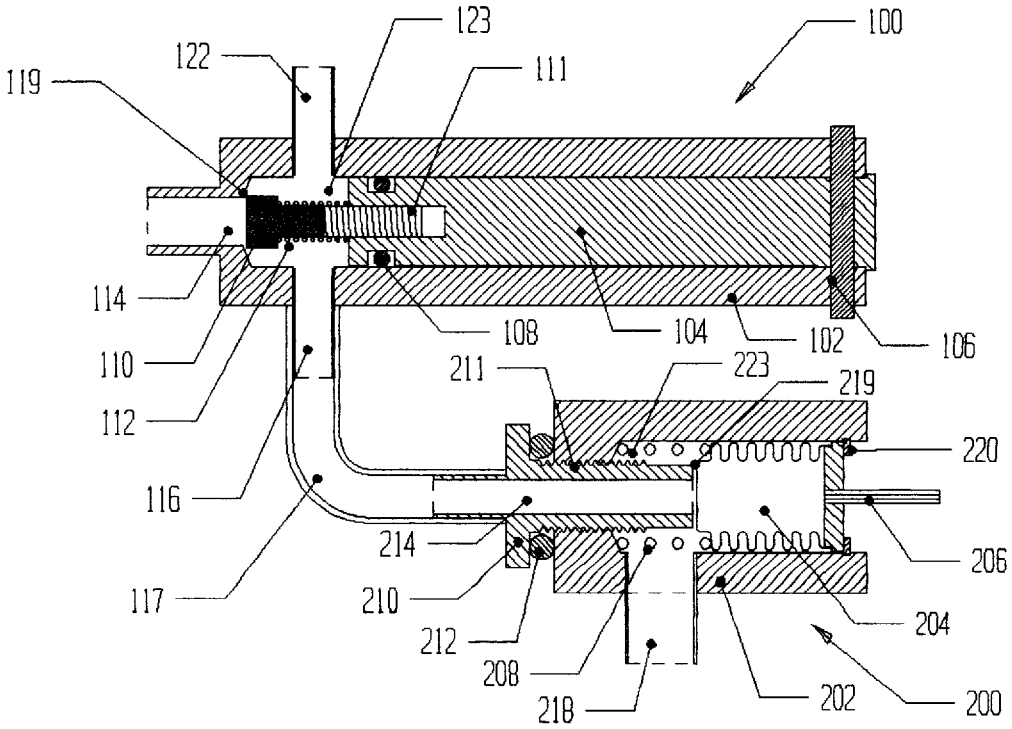
FIG. 2 shows a cross sectional view from the side of a temperature and atmospheric pressure responsive pressure splitter taken in a plane coinciding with the axis of the splitter, having one orifice responsive to temperature and one orifice responsive to pressure.

Description and Operation-FIG. 2

FIG. 2 shows temperature responsive orifice assembly 100 used in conjunction with a pressure responsive orifice assembly 200. Assembly 200 contains a body 202 which houses a pressure responsive member 204. Member 204 is preferably a sealed bellows, but may also be a sealed chamber with a diaphragm. Evacuation tube 206 is used to access the volume internal to the bellows for the purpose of establishing a pressure internal to the bellows, and may be fitted with a valve (not shown) to facilitate the evacuation of bellows 204. A spring 208 is used to hold bellows 204 against snap ring 220, and provides two functions. The first function is to maintain the relative position of the bellows base with respect to body 202, and secondly to establish the overall spring rate of the bellows. An adjustment member 210 is positioned and adjusted in body 202 using threads 211, and contains an outlet passage 214. The clearance between the end of passage 214 and the end of bellows 204 defines pressure responsive orifice 219. An "o" ring 212 may be used for sealing and to prevent unwanted rotation of member 210. High pressure exists at inlet 218. Mixing chamber 223 is used to reduce the gas or liquid flow speed before entering orifice 219.

The operation of this device is as follows. The first pressure, P1, preferably atmospheric pressure, is admitted to assembly 200 through inlet 218. The second pressure P2 is still at outlet 114, and the third or intermediate pressure P3 is still at port 122. A2 is still the effective size of the temperature responsive orifice 119, but now fixed orifice 120 with a fixed area A1 is replaced by pressure responsive orifice 219 with a variable area A1. It has been found that various combinations of active length, thermal expansion rates, and the area A2 of temperature responsive orifice 119 for the temperature responsive orifice assembly 100, and overall bellows spring rate, the level of evacuation of bellows 204, and the area A1 of the pressure responsive orifice 219 for the pressure responsive orifice assembly 200, can be used to shape the curve of the intermediate pressure P3 as a function of ambient temperature and pressure. Specifically, in this case, as the ambient temperature drops, at a given atmospheric pressure, A2 of orifice 119 decreases relative to A1 of orifice 219. This has the effect of moving intermediate pressure P3 closer to the inlet pressure P1 at inlet 218; in other words P3 increases. This is the same as described in FIG. 1. As atmospheric pressure drops, bellows 204 expands, compressing spring 208, and the effective area A1 of orifice 219 decreases relative to A2 or orifice 119. This has the effect of lowering P3, as it tends to be closer to the value of P2.

Figure 3:
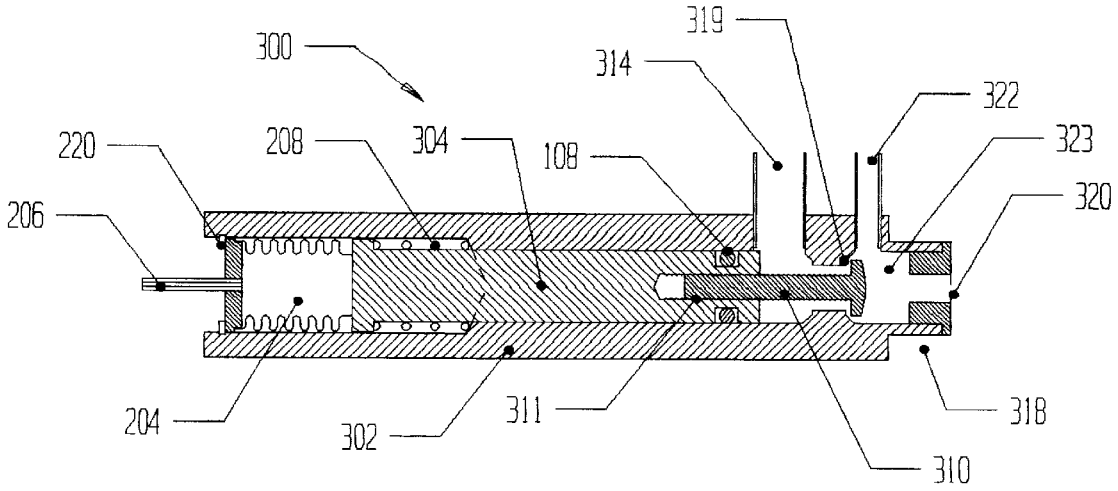
FIG. 3 shows a cross sectional view from the side of a temperature and atmospheric pressure splitter taken in a plane coinciding with the axis of the splitter, having one orifice responsive to temperature and pressure, and one orifice being fixed.

Description and Operation- FIG. 3

FIG. 3 shows another embodiment of a pressure splitter assembly 300 which uses a first fixed orifice 320 with effective area A1 with a second orifice 319 which is temperature and pressure responsive with a variable effective area A2. This assembly has a body 302 with a temperature responsive member 304 and a pressure responsive member (bellows) 204. Evacuation tube 206, spring 208, and snap ring 220 provide the same functions as in FIG. 2. "O" ring 108 provides centering and sealing as in FIG. 1. Bolt 310 is used to provide initial adjustment of the assembly using threads 311, and the clearance between the head of bolt 310 relative to body 302 determines the effective area, A2 of orifice 319. Outlet 314 is located in a region of second pressure P2, and intermediate pressure sensing port 322 provides access to intermediate pressure P3. First pressure P1 exists at inlet 318 outside fixed orifice 320 with area A1.

The operation of this device is as follows. A first pressure P1 is applied to orifice 320, and a second pressure P2 exists at outlet 314. The size, A2, of orifice 319 varies as a function of ambient pressure and temperature. A2 varies as a function of ambient pressure due to the movement of bellows 204. The temperature dependence of A2 is again obtained by using materials of different thermal expansion rates for body 302, and for temperature responsive member 304 and bolt 310. In this case however, because of the use of this device to change carburetor fuel flow discussed later, body 302 is made of the lower expansion rate material, aluminum, and member 304 is made from acetal homopolymer, a higher expansion rate material. In this case, bolt 310 is preferably made from nylon, which is a readily available product, nylon having a slightly lower rate of expansion than the acetal but higher than aluminum. The active length, in this case, is essentially the dimension from the contact point of bellows 204 and member 304 to the bottom of the head of bolt 310.

In this case, orifice 320 is fixed, having the value A1. The size A2 of orifice 319 changes as a function of temperature and pressure. As the ambient temperature drops, in this case member 304 and bolt 310 decrease in length faster than body 302, since body 302 is made of a lower expansion rate material. As the temperature lowers, bolt 310 moves toward body 302, causing A2 to decrease relative to A1 of orifice 320. This has the effect of raising P3, causing it to lie closer to P1. As the ambient pressure drops, bellows 204 expands, compressing spring 208, and causing bolt 310 to move farther from body 302. This tends to lower P3, moving it closer to the value of P2.

Figure 4:
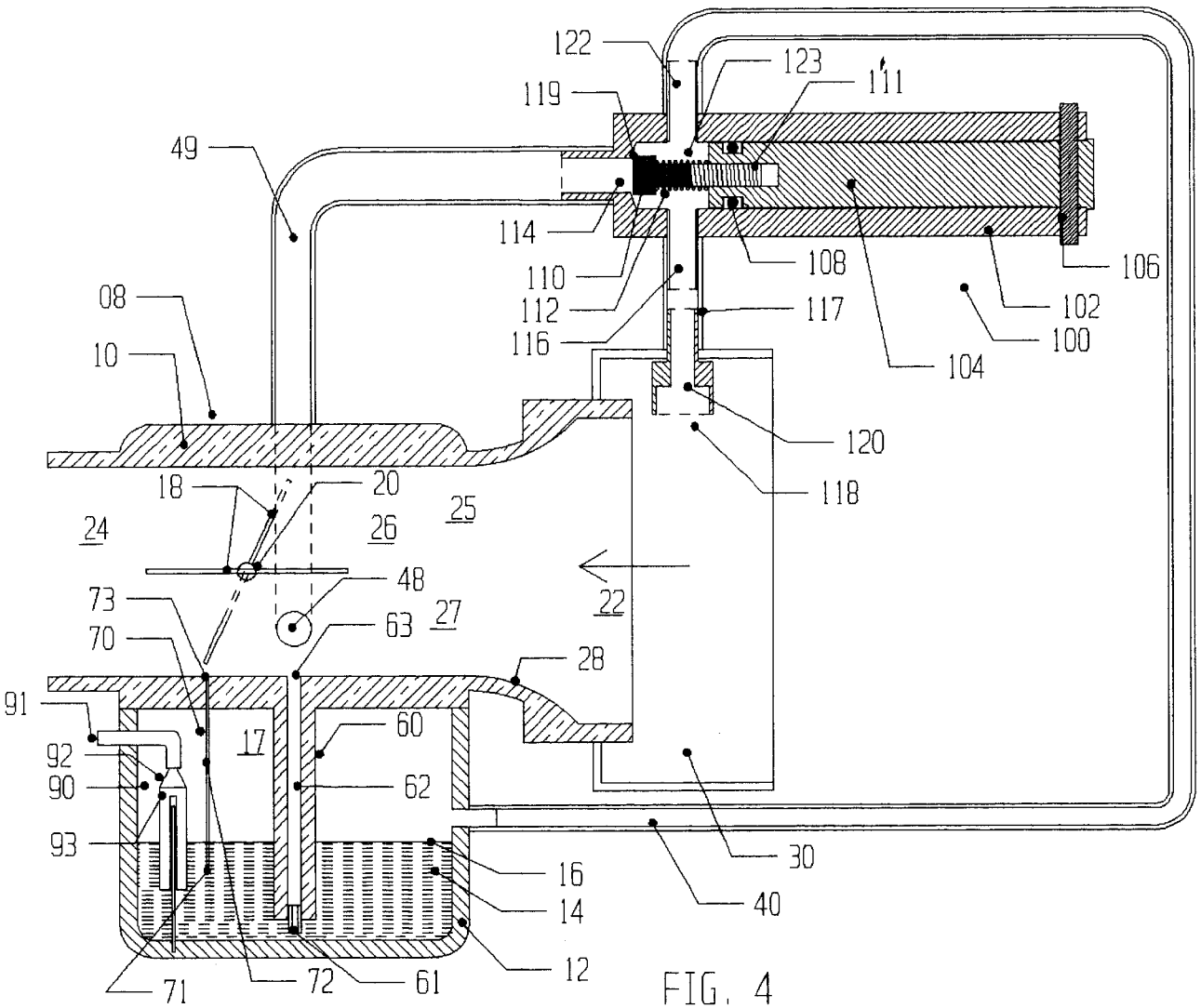
FIG. 4 shows a cross sectional view from the side of a float bowl carburetor with a temperature responsive splitter per FIG. 1 installed, taken in a plane coinciding with the axis of the carburetor and splitter.

Description and Operation-FIG. 4

FIG. 4 shows a float bowl carburetor assembly 08 with a pressure splitter installed in accordance with this invention. Carburetor body 10 is usually cast and then machined to provide all the drillings, tapped holes, and smoothing required for its proper operation. A float bowl 12 is attached to body 10 usually with screws and a sealing gasket, not shown. Fuel entry into the carburetor is controlled by a fuel inlet assembly 90, consisting of a fuel inlet conduit 91, fuel inlet valve 92, and fuel inlet float control mechanism 93. Fuel 14 is allowed to enter carburetor until a predetermined fuel level 16 is attained. Chamber 17 is the air space above the fuel level. A butterfly throttle valve 18 pivots on shaft 20 and is controlled by an accelerator linkage, not shown. Air enters the carburetor through an air filter 30, entering at air inlet or bell 22; a mixture of air and fuel exit at outlet 24. The entire drilling from bell 22 to outlet 24 is main bore 27. The part of 27 having the smallest cross sectional area is throat 26, and the section where bell 22 decreases in cross sectional area to the cross sectional area of throat 26 is called converging section 28. Throat 26 and converging section 28 comprise venturi 25. All the passageways connecting outlet 24 to atmospheric pressure comprise the air induction tract, this air induction tract normally essentially consisting of main bore 27. A high speed fuel delivery system 60 consists of high speed jet 61, high speed fuel delivery conduit 62, and high speed fuel outlet 63. Low speed fuel delivery system 70 consists of low speed jet 71, low speed fuel delivery conduit 72, and low speed fuel outlet 73.

The pressure splitter in this case consists of the temperature responsive orifice assembly 100 with the fixed orifice 120. Inlet 118 with fixed orifice 120 is in a region of essentially atmospheric pressure in air filter 30, and this is the first pressure P1. Conduit 117 connects orifice 120 to inlet 116. A main bore low pressure sensing port 48 is provided in main bore 27 preferably as close as possible to the main fuel outlet 63. The pressure in the region of port 48 is lower than atmospheric due to the motion of air past this port. This reduced pressure is the second pressure P2 discussed above, this pressure being transmitted to the pressure splitter by conduit 49. P2, being the reduced pressure existing in the carburetor throat, therefore exists at outlet 114 and hence on the low pressure side of orifice 119. The intermediate pressure, P3, exists at port 122, and is transmitted to chamber 17 through conduit 40.

The operation of this pressure splitter in regulating the carburetor fuel flow is as follows. It is of course the difference between the pressure in volume 17 of float bowl 12 and the pressure in throat 26 which forces the fuel up through the fuel outlets 63 and 73. If the pressure in chamber 17, the carburetor reference pressure, is decreased, the flow of fuel through the carburetor will be decreased. As discussed above, the splitter pressure P3 is imposed as the carburetor reference pressure, and therefore affects fuel flow. As the ambient temperature increases, temperature responsive orifice 119 increases, lowering P3. This reduction in P3 results in a reduction in chamber 17 pressure, and therefore a reduction in fuel flow. As the temperature of assembly 100 decreases, P3 increases, and fuel flow increases. Essentially, for the operation of this invention as a carburetor fuel flow regulating device, P3 is the carburetor reference pressure.

This change in fuel flow is desirable to compensate for the change in air density associated with a change in air temperature. As the absolute temperature of air decreases, its density increases linearly with its absolute temperature. If a constant fuel/air ratio is to be maintained, it is necessary to change the fuel flow in the manner described above.

Figure 5:
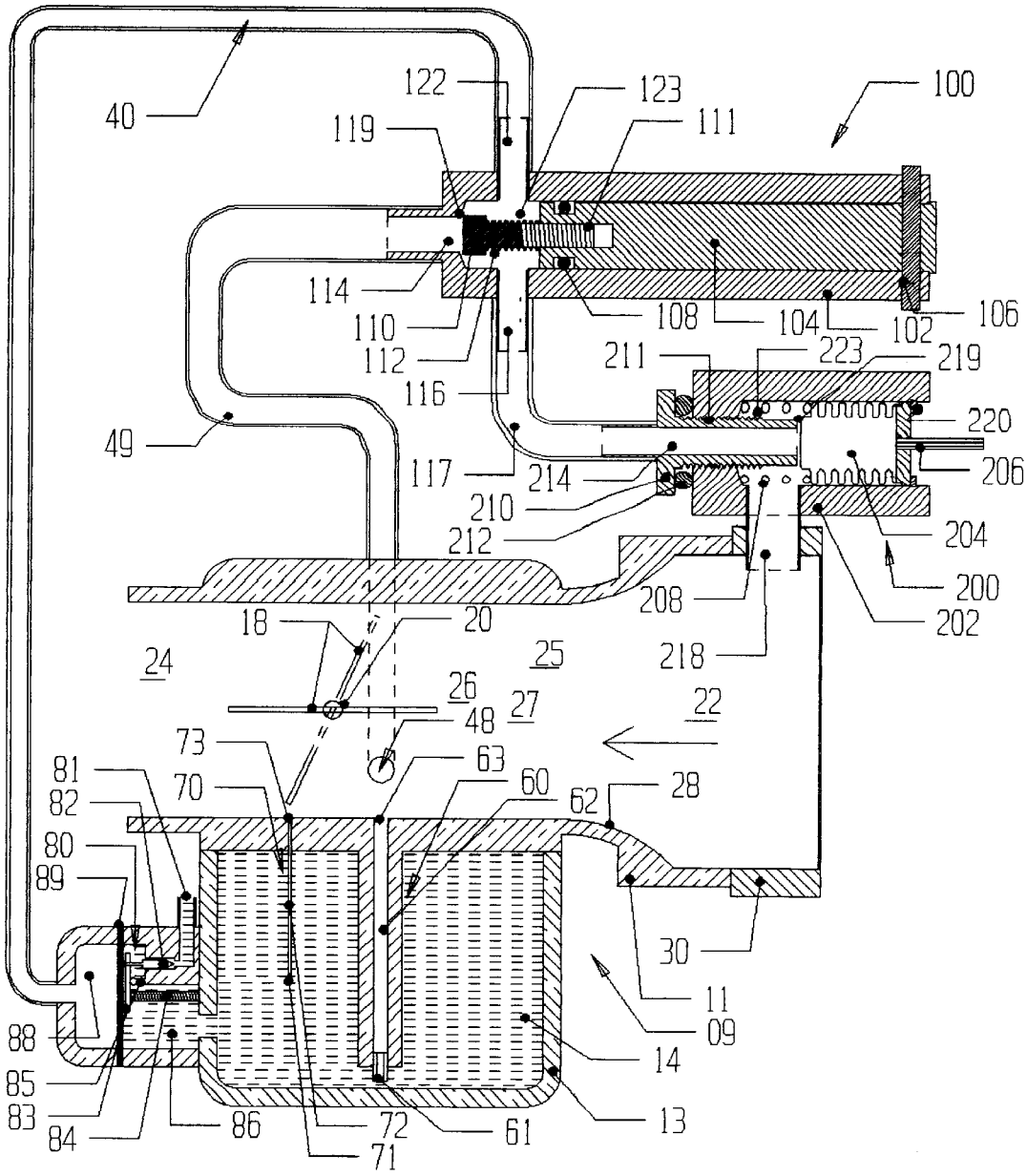
FIG. 5 shows a cross sectional view from the side of a wet diaphragm carburetor with a temperature and pressure responsive splitter per FIG. 2 installed, taken in a plane coinciding with the axis of the carburetor and splitter.

Description and Operation- FIG. 5

FIG. 5 shows the same cross section as FIG. 4 except showing a wet diaphragm carburetor 09 with a wet diaphragm carburetor body 11, and fixed orifice 120 has been replaced by a pressure responsive orifice assembly 200. The carburetor is essentially the same, except fuel chamber 13 is completely full of fuel under pressure. In fact, the entire carburetor is full of fuel except for diaphragm dry chamber 88. Fuel inlet assembly 80 consists of inlet conduit 81 which delivers fuel from a larger storage tank,not shown. Fuel inflow is controlled by valve 82, being operated by the action of diaphragm 89 on lever arm 83 pivoting on pin 85. Spring 84 in large part determines the fuel pressure existing in chamber 13. Diaphragm 89 senses on its dry side the pressure in chamber 88, and senses on its wet side fuel pressure in chambers 86 and 13.

Pressure responsive orifice assembly 200 is shown having its inlet 218 connected to a region of essentially atmospheric pressure, in air filter 30. Therefore, P1 is again essentially atmospheric pressure. As discussed in FIG. 2, the area of orifice 219,A1, located in assembly 200, is pressure dependent. As in FIG. 4, outlet 114 is connected through conduit 49 to port 48, and P2 in this case is again less than atmospheric, and is approximately the same pressure seen by main fuel outlet 63. A2, the area of orifice 119, is again located in assembly 100 and is temperature responsive. Port 122 again is in a region having intermediate pressure P3, and this intermediate pressure is transmitted to dry chamber 88 through conduit 40 and establishes the carburetor reference pressure.

The operation of this temperature and pressure dependent pressure splitter with the wet diaphragm carburetor 09 is as follows. The primary function of fuel inlet assembly 80 is to maintain a desired fuel pressure in chambers 86 and 13 to insure correct fuel delivery of the carburetor. This function is accomplished by the action of diaphragm 89 on valve 82. As fuel 14 is drawn from chamber 13 through jets 61 and 71, pressure in 13 starts to decrease. This decrease in pressure also occurs in chamber 86, and diaphragm 89 moves slightly from the dry side toward the wet side. This increases the opening of valve 82, causing an increased flow of fuel to the carburetor. This increased inflow increases pressure in chambers 86 and 13 which moves valve 82 toward the closed position. In this manner, the fuel pressure internal to the carburetor is maintained in a small range about some equilibrium value for satisfactory operation.

The air pressure in chamber 88, the carburetor reference pressure, is a factor in determining the pressure existing in fuel chambers 86 and 13. If the reference pressure in chamber 88, in this case P3, is decreased, the fuel pressure in chambers 86 and 13 will decrease, and fuel flow will decrease. Conversely, if the air pressure in chamber 88 is increased, the fuel pressure in chambers 86 and 13 will increase, and fuel flow will increase. In this manner, a pressure splitter can be used with this type of carburetor to vary fuel flow by applying a variable pressure to dry chamber 88.

The specific operation of this splitter is as follows. As atmospheric pressure decreases, the decreased density of the air requires a decrease in fuel flow to maintain a given fuel/air ratio. As discussed above, a decrease in atmospheric pressure causes A1 to decrease, causing P3 to decrease. This reduction in P3 is applied to diaphragm 89, resulting in a reduction in fuel pressure in chamber 13, and a reduction in fuel flow.

The effect of temperature on assembly 100 is the same as that discussed above concerning FIG. 4, except in this case P3 is applied to chamber 88 and hence to diaphragm 89. As the temperature increases, A2 increases relative to A1 (at any given atmospheric pressure), P3 decreases, resulting in a reduction in fuel flow.

It is therefore seen how a pressure splitter containing a temperature dependent orifice and a pressure dependent orifice can be used to modify carburetor fuel flow. As air density is determined by both absolute temperature and absolute pressure, this splitter is able to maintain a desired fuel/air ratio over a wide range of temperature and altitude.

Figure 6:
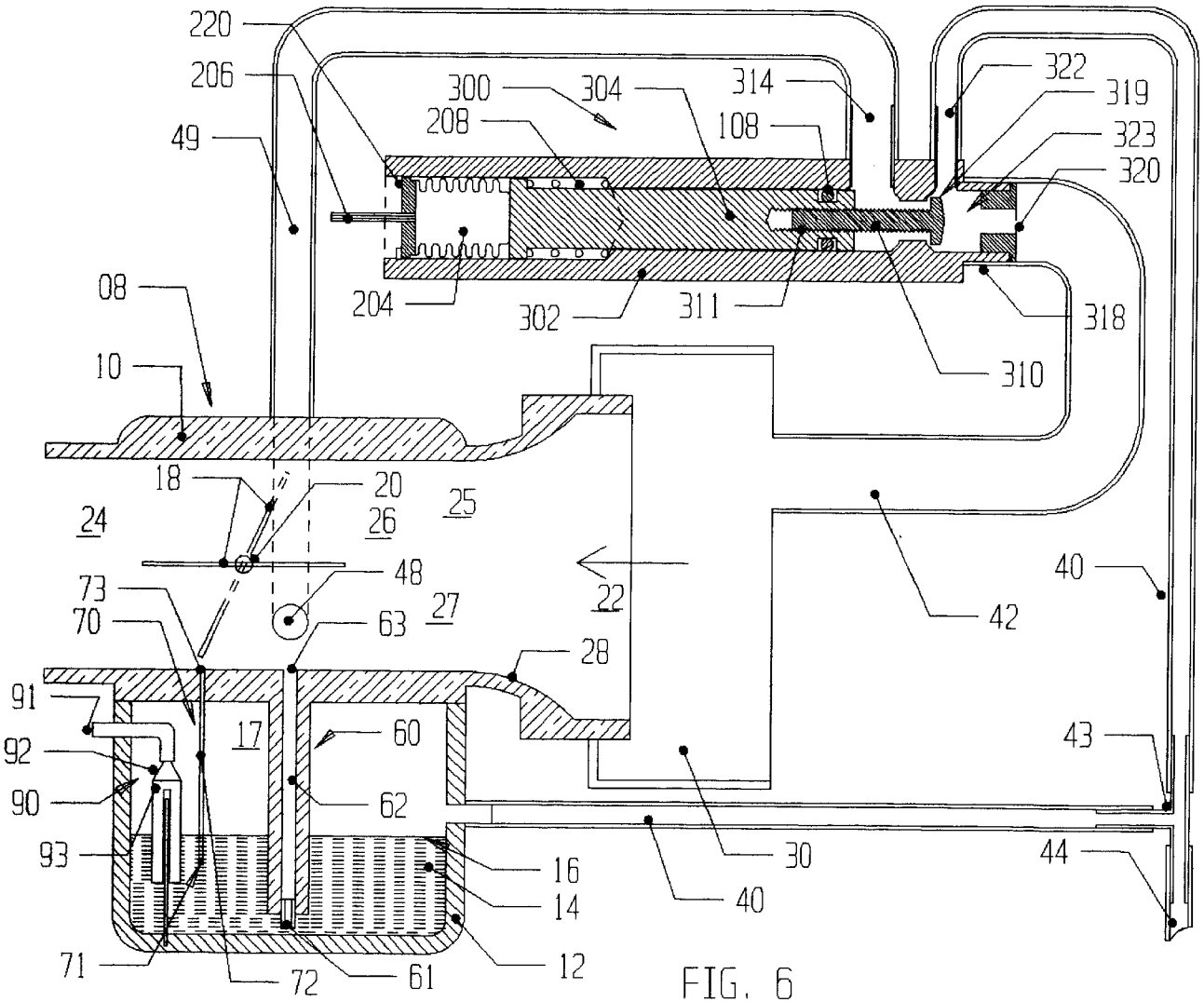
FIG. 6 shows a cross sectional view from the side of a float bowl carburetor with a temperature and pressure responsive splitter per FIG. 3 installed, taken in a plane coinciding with the axis of the carburetor and splitter.

Description and Operation- FIG. 6

FIG. 6 shows a cross section of a float bowl carburetor and the pressure splitter of FIG. 3. The carburetor is the same carburetor described in FIG. 4. In this case, the splitter has inlet 318 with fixed orifice 320 connected to air filter 30 through conduit 42. Therefore, P1, the pressure seen at orifice 320, is essentially atmospheric pressure and A1 is the size of orifice 320. Outlet 314 is connected to main bore low pressure sensing port 48 through conduit 49. Therefore, P2, the pressure in outlet 314, is essentially the same reduced pressure existing near high speed fuel outlet 63. Orifice 319 is responsive to temperature and pressure as described under FIG. 3. A2 again is the size of this orifice 324, and varies as temperature and atmospheric pressure change. Intermediate pressure exists at port 322, and is transmitted to float bowl chamber 17 by conduit 40.

Also shown is tubing "T" 43 and carburetor interconnecting conduit 44 used to connect multiple carburetors (not shown) together to the same reference pressure. In this manner, one splitter of any type described herein may be used to provide fuel flow regulation for engines with multiple carburetors, decreasing the cost of applying this fuel regulating system. In this case, turning screw 110 or 310 provides initial adjustment of all carburetors simultaneously. Of course, if desired, each carburetor may have its own splitter, allowing individual adjustment of the carburetors accomplished by adjusting screws 110 or 310.

Operation of this fixed orifice/temperature and pressure responsive orifice splitter with a float bowl carburetor is as follows. As temperature increases, the size, A2, of orifice 319 increases, having the effect of decreasing P3. This pressure P3 is transmitted to chamber 17, decreasing the flow of fuel. This delivers a decreased fuel flow to compensate for the decreased air density associated with the increase in air temperature. As atmospheric pressure decreases, bellows 204 expands, spring 208 compresses, and A2 again increases. This gives a further reduction in fuel flow, beneficial in compensating for the decreased air density associated with the decrease in atmospheric pressure.

Therefore, the combination of this splitter, having a fixed orifice and an orifice which is temperature and pressure responsive, is again able to provide modification of carburetor fuel flow, maintaining a desired fuel/air ratio even when relative air density changes.

Figure 7:
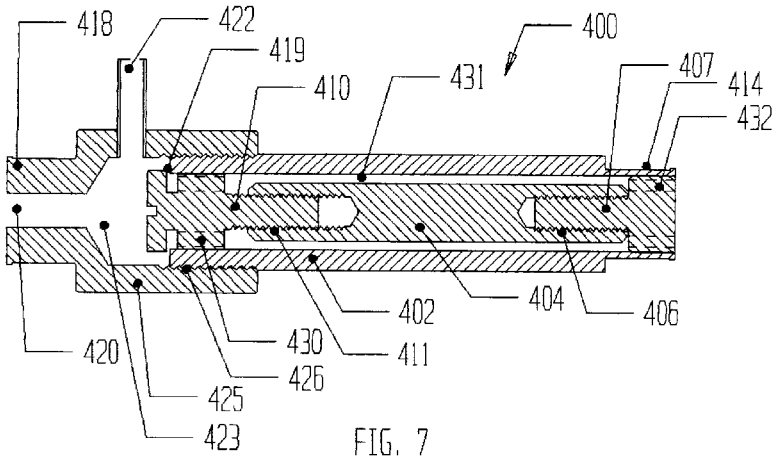
FIG. 7 shows a temperature responsive pressure splitter designed to minimize the thermal time constant of the splitter.

Description and Operation- FIG. 7

Yet another embodiment of a temperature responsive pressure splitter is shown in FIG. 7. In this case, body 402 and temperature responsive member 404 are made of different expansion rate materials. Preferably, adjustment member 410 and positioning member 407 are made of materials having similar expansion rates to the expansion rate of member 404. Inlet 418 containing fixed orifice 420 is in a region of pressure P1. Second pressure P2 is applied to orifice 419 through outlet 414. Flow is allowed between orifice 419 and outlet 414 by a passageway including passage(s) 432 in member 407, by passage(s) 430 in member 410, and by passage 431 created by the diametrical clearance between member 404 and body 402. Positioning member 407 is rigidly attached to member 404 by threads 405. In this design, member 407 is press fit into body 402 to fix the relative position of member 404 relative to body 402 in the location of member 407. Threads 411 are used to variably locate the position of member 410 relative to member 404 and hence to body 402. A cap 425 is positioned on body 402 using threads 426. Cap 425 contains mixing chamber 423, and contains intermediate pressure P3 sensing port 422.

The operation of this splitter is as follows. If member 404 and preferably members 407 and 410 are made from a material having a higher thermal expansion rate than body 402, an increase in temperature will cause adjustment member 410 to move away from body 402, toward cap 425, increasing the size A2 of orifice 419. Since orifice 420 has a fixed area A1, this will have the effect of causing the pressure P3 in chamber 423 to be closer to the second pressure P2. If member 404 and preferably members 407 and 410 are made from a material having a lower thermal expansion rate than body 402, the converse will occur.

This splitter has a lower thermal time constant than the splitters previously discussed due to the continuous flow of gas or fluid through body 402 and members 410 and 407. This thermal time constant is reduced due to the fact that a moving medium transfers heat faster than a stagnant medium. Also, body 402 and members 407 and 410 are subjected to thermal transfer from both the inside and outside. This reduction in thermal time constant is beneficial in most cases to allow the splitter to more quickly follow changes in ambient temperature. For instance, a snowmobile, if stored in a warm garage, and then run outdoors in an ambient temperature of −40 degrees, would benefit from a splitter with as short a thermal time constant as possible. It is estimated that the splitters shown in FIGS. 1 and 3 have a thermal time constant in the range of 30 minutes. The splitter shown in FIG. 7 is estimated to have a time constant in the range of 10 minutes.

Cap 425 is easily removed from body 402 allowing inspection and adjustment of the clearance between member 410 and body 402. Member 410 and body 402 have flat surfaces in the area of orifice 419, allowing easy initial setting of the splitter using a feeler gauge to establish the clearance which determines A2.

Figure 8:
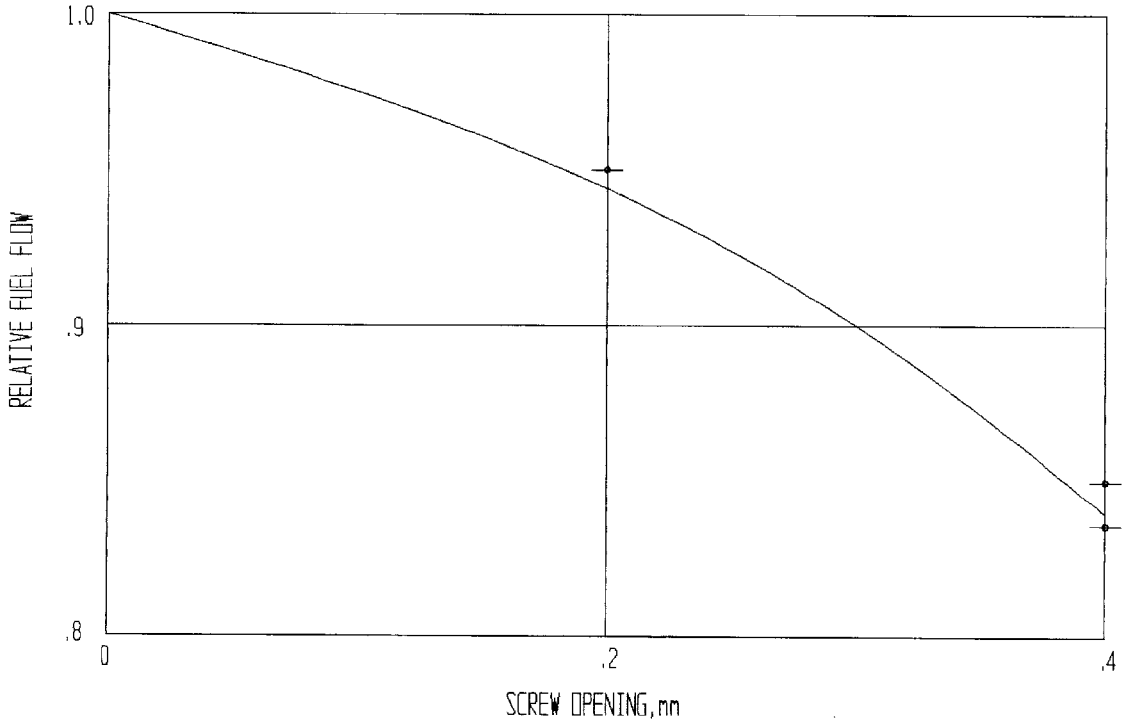
FIG. 8 shows test results of the calculated and actual fuel flow of a system of carburetors controlled by a pressure splitter of this invention.

Description and Operation- FIG. 8

A pressure splitter similar to that shown in FIG. 3 was constructed, except the bellows/pressure responsive portion was omitted. This splitter was connected to three float bowl carburetors, having inlet 318 in a region of atmospheric pressure. Outlet 314 was connected to a drilling in the carburetor bore near high speed fuel outlet 63, and intermediate pressure sensing port 322 was connected to all three carburetor chambers 17 using tubes 44 and "T"s 43, similar to that shown in FIG. 6. Total fuel flow through the three carburetors was measured as a function of the spacing of screw 310 with respect to body 302. With a spacing of 0 mm (0 inches), there was no detectable difference in fuel flow from normal flow with atmospheric pressure as the carburetor reference pressure. The relative fuel flow in this case therefore is 1. With a spacing of 0.2 mm (0.008 inches), the relative fuel flow was 0.95. With a spacing of 0.4 mm (0.016 inches), the relative fuel flow was measured to be in a range of 0.84 to 0.85. The solid line represents the predicted fuel flow using the formula relating P1, P2, P3, A1, and A2.

This splitter was designed to move 0.2 mm (0.008 inches) for every 80 degree F change in temperature. The splitter was subjected to reduced temperature, and the movement of screw 110 relative to body 102 was as expected. This splitter will therefore approximately reduce relative carburetor fuel flow from 0.95 to 0.84 in a temperature range of 80 degrees F.

Summary, Ramification, and Scope

Accordingly, the reader will see that this invention provides a pressure splitter which has an intermediate pressure which changes according to ambient temperature. This splitter is simple in design with no moving parts, using materials with different expansion rates to change the intermediate pressure. It has been shown how to add a pressure responsive element to the basic temperature dependent splitter to obtain a splitter which responds to both atmospheric temperature and pressure. It has also been shown how to use the temperature responsive splitter and the temperature and pressure responsive splitter to adjust carburetor fuel flow to maintain a desired fuel/air ratio even as relative air density changes. It has further been shown how the thermal time constant of a temperature responsive splitter can be reduced to improve the response time of the splitter. These splitters all have an adjustable element which provides an easy method of initial adjustment and basic carburetor tuning.

Although the description above contains many specificities, these should not be construed as limiting the scope of the invention but as merely providing illustrations of some of the presently preferred embodiments of this invention. There are too many combinations of orifices and their response characteristics to be presented here. For instance, it is possible to make the areas of both orifices A1 and A2 responsive to temperature, but in the reverse direction. This would increase the change in intermediate pressure P3 for any given temperature change. Also, the discussion here has been limited to a splitter with two series orifices. Many orifices can be used in series and parallel combinations, some being fixed, some being temperature responsive, some being pressure responsive, and some being temperature and pressure responsive. These additional combinations of orifices can be used to provide additional shaping of the intermediate pressure P3 as a function of temperature and pressure. Thus the scope of the invention should be determined by the appended claims and their legal equivalents, rather than by the examples given.

I claim:

1. A pressure splitter, said pressure splitter including:

a body, an inlet with a first pressure P1, an outlet with a second pressure P2, a system of orifices between said inlet and said outlet, an intermediate pressure P3 existing in a region between two said orifices, an intermediate pressure sensing port to access said intermediate pressure P3, at least one said orifice being a temperature responsive orifice with a variable effective area, said temperature responsive orifice having a temperature responsive means, said temperature responsive means including a temperature responsive member joined at a predetermined point to said body, said body having a thermal expansion rate, said temperature responsive member having a thermal expansion rate, said body thermal expansion rate and said temperature responsive member thermal expansion rate being operationally different, whereby said body and said temperature responsive member move relatively in response to temperature changes, whereby said effective area of said temperature responsive orifice changes in response to temperature changes, thereby changing said intermediate pressure P3 in response to temperature.

2. The pressure splitter of claim 1 wherein said temperature responsive orifice is a temperature and pressure responsive orifice with a variable effective area, said temperature and pressure responsive orifice including said temperature responsive means and a pressure responsive means, said pressure responsive means including a pressure responsive member which changes dimension in response to changes in ambient pressure, said pressure responsive member being effective in moving said temperature responsive member, whereby said temperature responsive member moves relative to said body in response to both temperature and pressure changes, whereby said effective area of said temperature and pressure responsive orifice changes in response to both temperature and pressure changes, thereby changing said intermediate pressure P3 in response to both temperature and pressure changes.

3. The pressure splitter of claim 2, wherein a connecting passageway of said splitter includes portions of said temperature responsive member and said body, thereby reducing the thermal time constant of said pressure splitter.

4. The pressure splitter of claim 2, wherein said pressure splitter is used to control fuel flow of a carburetor, said carburetor including an air induction tract, a reference pressure, a fuel flow affected by the difference in a pressure of said air induction tract and said reference pressure, said pressure splitter having said inlet with said first pressure P1 at approximately atmospheric pressure, said pressure splitter having said outlet with said second pressure P2 established by a pressure in said air induction tract, said pressure splitter intermediate pressure sensing port with said intermediate pressure P3 connected to said carburetor, thereby changing said carburetor reference pressure in response to changes in ambient temperature and pressure, thereby changing said carburetor fuel flow in response to changes in ambient temperature and pressure.

5. The pressure splitter of claim 4, wherein said pressure splitter controls said fuel flow of more than one carburetor.

6. The pressure splitter of claim 1, including in addition to said temperature responsive orifice, a pressure responsive orifice with a variable effective area, said pressure responsive orifice including a pressure responsive means, said pressure responsive means including a pressure responsive member which changes dimension in response to changes in ambient pressure, said pressure responsive member being effective in changing said effective area of said pressure responsive orifice, whereby said effective area of said pressure responsive orifice changes in response to changes in ambient pressure, thereby changing said intermediate pressure P3 in response to both temperature and pressure.

7. The pressure splitter of claim 6, wherein a connecting passageway of said splitter includes portions of said temperature responsive member and said body, thereby reducing the thermal time constant of said pressure splitter.

8. The pressure splitter of claim 6, wherein said pressure splitter is used to control fuel flow of a carburetor, said carburetor including an air induction tract, a reference pressure, a fuel flow affected by the difference in a pressure of said air induction tract and said reference pressure, said pressure splitter having said inlet with said first pressure P1 at approximately atmospheric pressure, said pressure splitter having said outlet with said second pressure P2 established by a pressure in said air induction tract, said pressure splitter intermediate pressure sensing port with said intermediate pressure P3 connected to said carburetor, thereby changing said carburetor reference pressure in response to changes in ambient temperature and pressure, thereby changing said carburetor fuel flow in response to changes in ambient temperature and pressure.

9. The pressure splitter of claim 8, wherein said pressure splitter controls said fuel flow of more than one carburetor.

10. The pressure splitter of claim 1, wherein a connecting passageway of said splitter includes portions of said temperature responsive member and said body, thereby reducing the thermal time constant of said pressure splitter.

11. The pressure splitter of claim 1, wherein said pressure splitter is used to control fuel flow of a carburetor, said carburetor including an air induction tract, a reference pressure, a fuel flow affected by the difference in a pressure of said air induction passage and said reference pressure, said pressure splitter having said inlet with said first pressure P1 at approximately atmospheric pressure, said pressure splitter having said outlet with said second pressure P2 established by a pressure in said air induction tract, said pressure splitter intermediate pressure sensing port with said intermediate pressure P3 connected to said carburetor, thereby changing said carburetor reference pressure in response to changes in ambient temperature, thereby changing said carburetor fuel flow in response to changes in ambient temperature.

12. The pressure splitter of claim 11 wherein said pressure splitter controls said fuel flow of more than one carburetor.

* * * * *